United States Patent [19]

Tani et al.

[11] Patent Number: 4,825,774

[45] Date of Patent: May 2, 1989

[54] UNDERFLOOR CONSTRUCTION OF MONORAIL VEHICLE AND METHOD OF ASSEMBLING THE SAME

[75] Inventors: Hisashi Tani; Katsuyuki Terada; Michifumi Takeichi, all of Kudamatsu, Japan

[73] Assignee: Hitachi, Ltd., Tokyo, Japan

[21] Appl. No.: 159,900

[22] Filed: Feb. 24, 1988

[30] Foreign Application Priority Data

Mar. 2, 1987 [JP] Japan ..... 62-45232

[51] Int. Cl.[4] ..... B61D 49/00

[52] U.S. Cl. ..... 105/141; 105/60; 105/140; 105/172; 105/238.1; 105/396; 105/413; 105/456

[58] Field of Search ..... 104/118, 120, 287; 105/141, 238.1, 396, 140, 409, 413, 414, 416, 418, 29.2, 1.5, 1.1, 49, 60, 172, 176, 199.1, 206.1, 423, 456; 248/58, 62; 296/208

[56] References Cited

U.S. PATENT DOCUMENTS

| | | | |
|---|---|---|---|
| 730,251 | 6/1903 | Gibbs | 105/49 |
| 2,093,535 | 9/1937 | Adams et al. | 105/1.1 |
| 2,098,517 | 11/1937 | Pflazer | 105/1.1 |
| 3,115,845 | 12/1963 | Girz | 104/120 |
| 3,147,714 | 9/1964 | Appelt et al. | 104/120 |
| 3,966,154 | 6/1976 | Perrault et al. | 248/62 |

FOREIGN PATENT DOCUMENTS

| | | | |
|---|---|---|---|
| 45142 | 1/1969 | German Democratic Rep. | 248/62 |
| 2642 | 1/1972 | Japan . | |
| 164010 | 11/1933 | Switzerland | 173/251 |

*Primary Examiner*—Andres Kashnikow
*Assistant Examiner*—Mark T. Le
*Attorney, Agent, or Firm*—Antonelli, Terry & Wands

[57] ABSTRACT

The workability during fabrication of an underfloor construction of a monorail vehicle is improved by reducing the steps of fabrication. An underfloor construction of a monorail vehicle comprises truck enclosures detachably mounted at positions where trucks are mounted in the undersurface of the underframe to enclose the periphery of the trucks, and an enclosure for underfloor equipment for enclosing the sides and lower surface of the underfloor equipment. A method of assembling an underfloor construction of a monorail vehicle comprises mounting a wiring duct and underfloor equipment on the undersurface of an underframe, conducting wiring work between the wiring duct and the underfloor equipment, and thereafter mounting an enclosure for underfloor equipment.

4 Claims, 4 Drawing Sheets

UNDERFLOOR CONSTRUCTION OF MONORAIL VEHICLE AND METHOD OF ASSEMBLING THE SAME

BACKGROUND OF THE INVENTION

1. Field of the Invention

The present invention relates to an underfloor construction of a monorail vehicle and method of assembling the same.

2. Description of the Prior Art

In guideway vehicles, it has been a tendency to mount various equipment under the floor. Particularly, in monorail vehicles, various equipment are mounted on the opposite sides of the underfloor portion of the vehicle body. For a wiring duct for receiving wires, the wiring duct in the form of a box is mounted within an underframe or underside of the underframe.

A monorail vehicle often travels on an elevated track. Accordingly, for the purpose of improving the external appearance of the vehicle body, the overall surface of the aforementioned underfloor equipment is covered with skirts.

The underfloor construction of the aforementioned monorail vehicle is disclosed, for example, in Japanese Utility Model Publication No. 20,452/1983.

In this structure, the underfloor equipment frame is formed into several blocks and mounted on the underframe.

In the case of the underfloor construction as described above in the monorail vehicle, a framework constituting the skirts has to be mounted directly on the undersurface of the underframe. Accordingly, after the underframe itself has been fabricated, the framework is to be mounted, and therefore the manufacturing period becomes prolonged. Moreover, the operation for combining the framework and underframe or mutual frameworks is cumbersome, requiring a number of fabricating steps.

Furthermore, since various equipment are mounted on the framework, the framework is formed from rigid molded materials which in turn increases the weight of the entire vehicle body.

After the framework for forming the skirts on the undersurface of the underframe as mentioned above has been mounted, the wiring duct or various equipment have to be mounted, in which case, working space is narrow and therefore the workability was poor.

Next, a conventional wiring duct is in the form of a box, which has been fastened to a cross beam forming the underframe by means of bolts or the like. Furthermore, the wiring duct itself need be welded or subjected to plastic processing. Constituent members are often coupled together by means of screws, which work is cumbersome. Further, when both low and high voltage wirings are installed in a single wiring duct, an electromagnetic interference occurs resulting in an erroneous operation of equipment. Therefore, such an installation is not carried out. The wires are not satisfactorily fixed, and the wires tend to be displaced and damaged, the wires being short-circuited. One example of the wiring duct of this kind is disclosed, for example, in Japanese Patent Publication No. 2,642/1972.

SUMMARY OF THE INVENTION

It is an object of the present invention to provide an underfloor construction of a monorail vehicle and method of assembling the same which can eliminate the aforementioned inconveniences and improve the workability to minimize the number of fabricating steps.

According to one feature of the present invention, there is provided an arrangement which comprises an enclosure for a truck detachably installed at a position of the undersurface of the underframe where a truck is installed and enclosing the periphery of the truck, and an enclosure for underfloor equipment detachably installed adjacent to the enclosure for the truck and enclosing the sides and lower surfaces of the equipment.

According to another feature of the present invention, there is provided an arrangement wherein a wiring duct and underfloor equipment are mounted on the undersurface of the underframe, and wiring work is carried out between the wiring duct and the underfloor equipment, after which the enclosure for enclosing the sides and lower surface of said underfloor equipment is mounted.

DESCRIPTION OF THE PREFERRED EMBODIMENT

Figure 1:
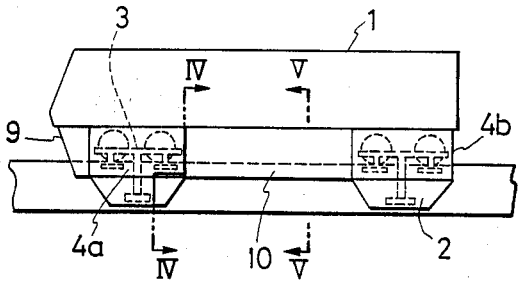
FIG. 1 is a side view of a monorail vehicle provided with one embodiment of an underfloor construction according to the present invention.
Figure 2:
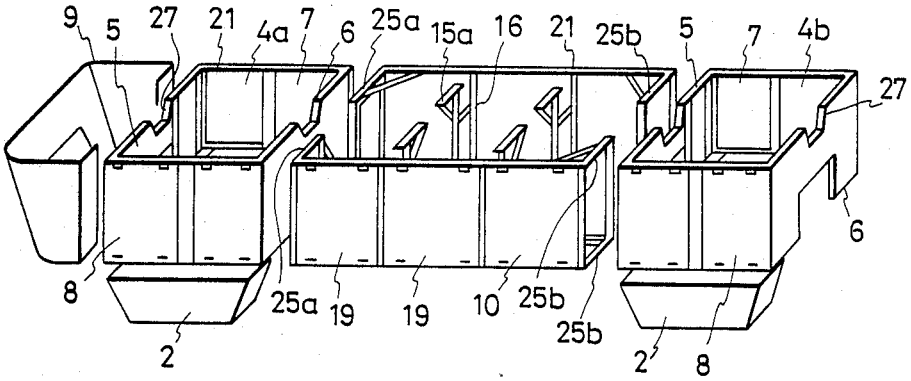
FIG. 2 is a perspective view showing only a skirt portion of FIG. 1.
Figure 3:
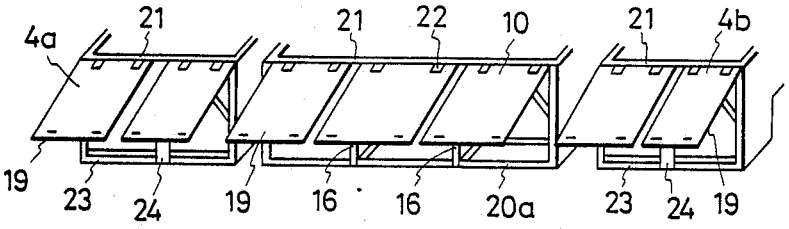
FIG. 3 is a perspective view showing a state in which the side skirt in FIG. 2 is opened.

The present invention will be described hereinafter in detail with reference to the drawings. First, referring to FIGS. 1, 2, 3, 4 and 5, among the underfloor construction, the skirt portion will be described. A vehicle body indicated at 1 is supported by a plurality of trucks which travel on the track. Reference numeral 2 designates a lower skirt for enclosing a portion of a stabilizing wheel provided under the truck 3. This lower skirt 2 is provided to reduce the noises which are transmitted from the lower portion of the truck 3 to outside. The lower skirt 2 is totally formed from reinforced plastic or the like. The skirt is mounted on the enclosure for the truck which will be described below. Reference numeral **4*a* designates an enclosure for a truck formed so as to encircle the periphery of one truck 3. This truck enclosure, the enclosure for truck which is 4*a* is the enclosure for truck which is composed of a front enclosure panel 5 and a rear enclosure panel 6, which are arranged in front of and at the rear of the truck 3, respectively, and side panels 7 and 8 arranged on the left and right sides, respectively, of the truck 3. The truck enclosure 4*b* is composed of a front enclosure panel 5, a rear enclosure panel 6, a side panel 7 and a side panel 8, similarly to the aforesaid enclosure for truck 4*a*. The enclosure 4*b* is provided so as to surround another truck 3 supporting the vehicle body 1. Reference numeral 9 designates a front skirt mounted frontwardly of the truck enclosure 4a. The truck enclosures 4a and 4b are mounted on an underframe 13 constituting the vehicle body 1 by means of detachable fastening means such as bolts, nuts and the like. Upper frames 21 are mounted on upper edges of the truck enclosures 4a and 4b so that they may be extended over the entire periphery of each of the truck enclosures 4a and 4b. The truck enclosures 4a and 4b are mounted on the underframe 13 through the upper frame 21. The side panels 7 and 8 are composed of a skirt 19 pivotably mounted on the upper frame 21 through a hinge 22. Reference numeral 23 designates a lower frame provided on the lower edge. Reference numeral 24 designates a support frame installed vertically between the upper frame 21 and the lower frame 23. The lower end and the side end of the skirt 19 are supported by the lower frame 23 and the support frame 24. Reference numeral 27 designates a notch formed in the central and upper portion of the front enclosure panel 5 and rear enclosure panel 6. The notch 27 is formed corresponding to a sectional shape of a wiring duct 28 installed on the undersurface of the underframe 13**.

Next, reference numeral 10 designates an enclosure for underfloor equipment at the lower part of the vehicle body 1 between the truck enclosures 4a and 4b. The enclosure for underfloor equipment 10 is provided to enclosure the sides and bottom portion of underfloor equipment 11 installed on the lower portions of the vehicle body 1, that is, the underfloor portion. Reference numeral 16 designates outside supports installed vertically at lower positions on opposite sides of the underframe 13. Reference numeral 15 designates inside supports installed vertically at the central and lower position of the underframe 13. Reference numeral 21 designates an upper frame for connecting upper ends of the plurality of outside supports 16. Reference numerals 20a and 20b designate lower frames for connecting the lower ends of the outside supports 16 and the inside supports 15. The enclosure for underfloor equipment 10 is composed of the inside supports 15, the outside supports 16, the upper frame 21, the lower frames 20a, 20b and the skirt 19. The skirt 19 is pivotably mounted on the upper frame 21 by means of the hinge 22 similarly to the truck enclosures 4a, 4b, and has a shape similar thereto. The lower frames 20a and 20b are connected by a joint member 20c horizontally arranged in a lateral direction of the vehicle body and take the form of a ladder, on which small equipment 12 such as switches are installed. To the undersurface of the lower frames 20a, 20b and a joint frame 25 are attached plate material with which the lower surface of the underfloor equipment 10 is covered. Joint frames 25a, 25b are mounted on the ends lengthwise of the vehicle body of the upper frame 21 and the lower frames 20a, 20b. The enclosure for underfloor equipment 10 is connected to the truck enclosures 4a and 4b through the joint frames 25a and 25b. Reference numeral 17 designates side beams formed on opposite sides in a lateral direction of the vehicle body of the underframe 13. The enclosure for underfloor equipment 10 is mounted on fitting rails 18 formed on the undersurface of the side beams 17 by means of detachable fastening members such as bolts. More specifically, the upper frame 21 is mounted on the fitting rail 18 by bolts and nuts, for example. On the other hand, a coupling material 15a installed in a lateral direction of the vehicle body is mounted on the upper portion of the inside support 15. This coupling material 15a is mounted on the fitting rail 14 formed on the undersurface of the underframe 13 by means of detachable coupling members. The inside support 15 is supported stably with respect to the lateral direction of the vehicle body. The underfloor equipment 11 encased in the enclosure for underfloor equipment 10 is mounted on the fitting rail 14 of the underframe 13, and is positioned between the inside supports 15 and the outside supports 16 arranged in a spaced apart relation in a longitudinal direction of the vehicle body.

With the above-described arrangement, the mounting of the enclosures 4a and 4b, the front skirt 9 and the enclosure for underfloor equipment 10 is carried out after the mounting work for the underfloor equipment 11 and wiring duct 28, the wiring work and the piping work have been terminated.

The truck enclosures 4a, 4b and the enclosure for underfloor equipment 10 are respectively fabricated in the form of a single body and are detachable with respect to the underframe 13. Therefore, they can be fabricated separately from the underframe 13 to improve the workability. Also, when the mounting work of the underfloor equipment 11 on the underframe 13, the wiring work and the piping work are being carried out, the truck enclosures 4a, 4b and enclosure for underfloor equipment 10 are not yet installed, and therefore, the workability can be improved. Accordingly, the number of working steps can be reduced. For the truck enclosures for truck 4a and 4b, a soundproof construction is employed so as not to transmit noises generated from the trucks 3 to outside, which construction is complicated. Accordingly, the fabrication of the truck enclosures 4a, 4b in the form a single body as described above is particularly effective for improvement of the workability. Further, the enclosure for underfloor equipment 10 requires no high rigidity since the enclosure 10 is small in size and merely supports light-weight equipment 12. Accordingly, various members constituting the enclosure for underfloor equipment 10 can be made to be thin and light-weight. This reduces the weight of the entire vehicle body 1.

Figure 4:
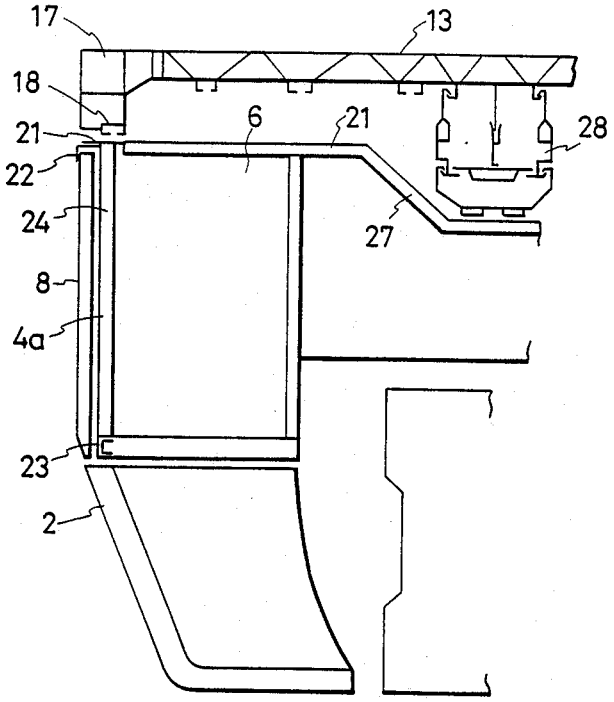
FIG. 4 is a sectional view taken on line IV—IV of FIG. 1.
Figure 5:
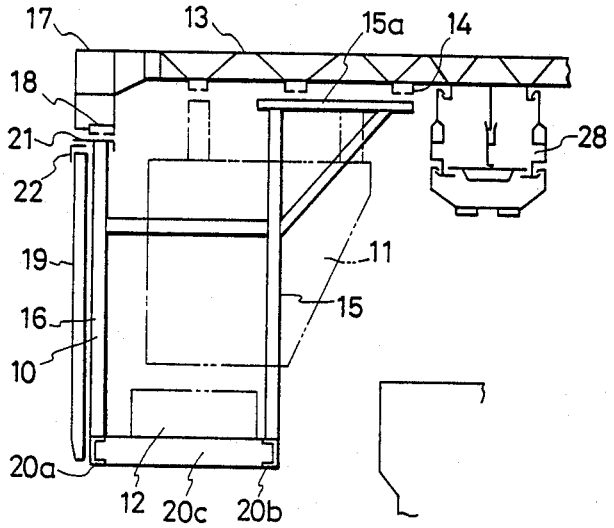
FIG. 5 is a sectional view taken on line V—V of FIG. 1.
Figure 6:
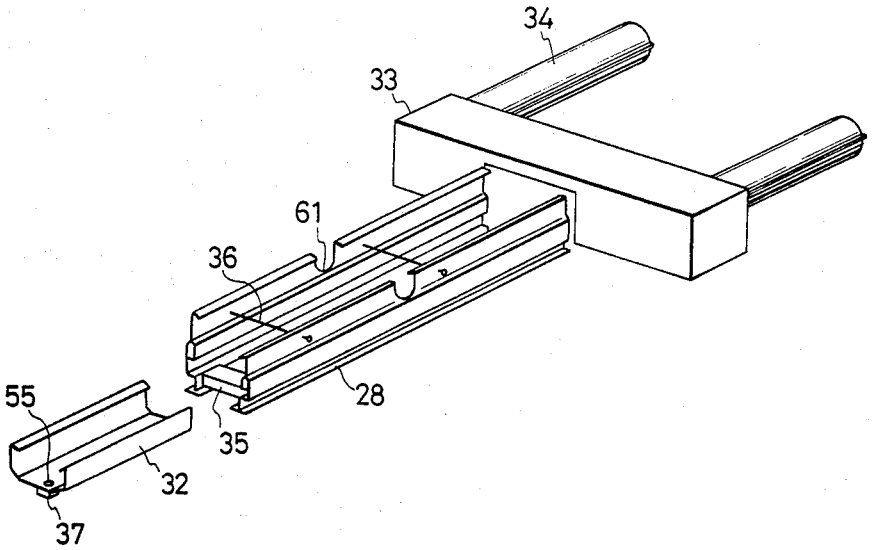
FIG. 6 is a perspective view showing a wiring duct installed on the monorail vehicle shown in FIG. 1.
Figure 7:
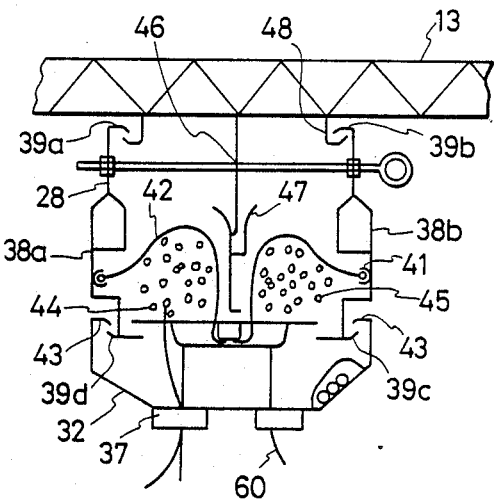
FIG. 7 is a sectional view showing a state in which the wiring duct of FIG. 6 is mounted on the vehicle body.
Figure 8:
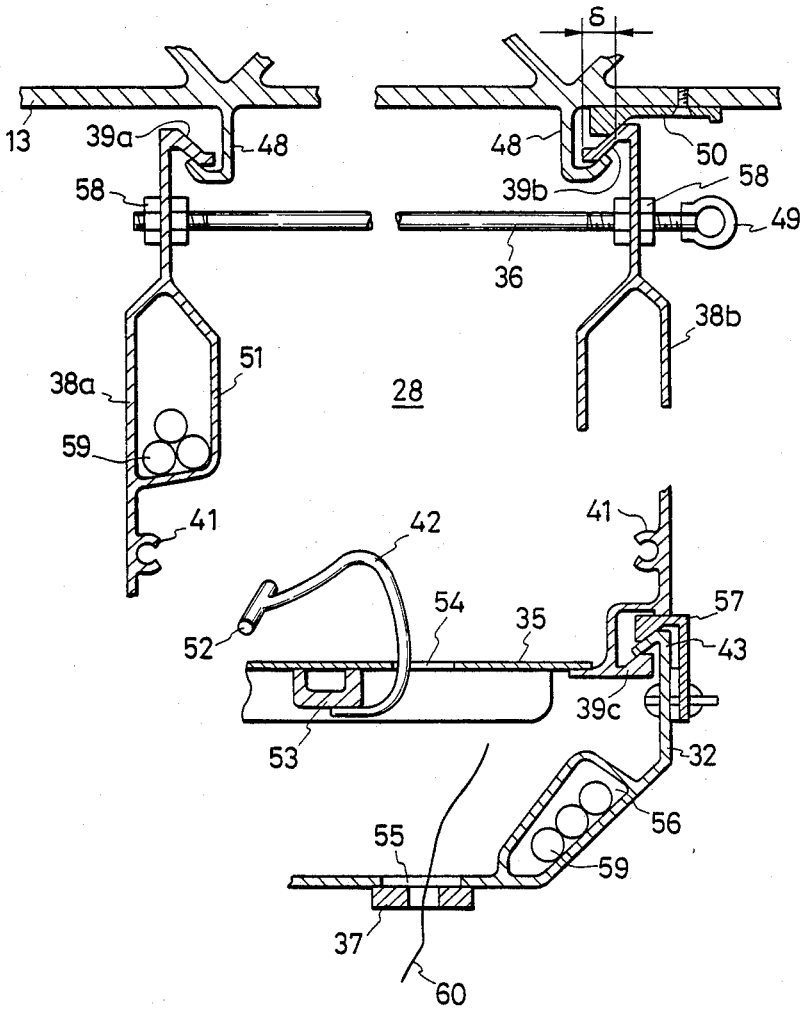
FIG. 8 is a sectional view, in an enlarged scale, of essential parts of the wiring duct shown in FIG. 7.

In the following, the detailed construction of the wiring duct 28 shown in FIG. 4 will be described with reference to FIGS. 6, 7 and 8. Reference numeral 48 designates hooks continuously formed on the undersurface of the underframe 13 in the longitudinal direction of the vehicle body, and has a section in the form of a hook. The hooks 48 are provided at positions where the wiring duct 28 in the central portion of the underframe 13 is installed to support the wiring duct 28. The wiring duct 28 is composed of side panels 38a, 38b positioned on opposite sides thereof and a wire support 35 provided to connect the side panels 38a, 38b in a predetermined pitch. The wiring duct 28 has a shape in which the upper portion thereof is open. The side panels 38a, 38b and the wire support 35 are connected by welding or connecting means such as rivets. The side panels 38a, 38b are internally formed with a fixed groove 41. Fitted into the fixed groove 41 is a support 52 formed on the end of a band 42 for bundling and fixing wires. The side panels 38a, 38b are also internally formed with a hollowed section 51 if needed. This hollowed section 51 incorporates therein three-phase wiring 59 which adversely affects, such as an electromagnetic interference on, other wirings. The provision of the three-phase wiring 59 within the hollowed section 51 can prevent the electromagnetic interference.

The aforesaid wire supports 35 are disposed at a pitch of 500 mm to 700 mm in the longitudinal direction of the vehicle body between the side panels 38*a* and 38*b*. Each of the wire supports 35 are formed with a hole 54 through which said band 42 extends to fix the bundle of the wires and a screw support 53 adapted to fix the band 42 by means of a screw. Reference numeral 32 designates a lead wire cover installed under the side panels 38*a*, 38*b*. On the upper ends on opposite sides of the lead wire cover 32 are formed hooks 43 in engagement with hooks 39*d*, 39*c* formed at the lower parts of the side panels 38*a*, 38*b*, respectively. The lead wire cover 32 has a section in the form of a groove and is formed at the bottom with a lead wire hole 55 for pulling out a wire 60. Mounted on the hole 55 is a cleat 37 for fixing the wire 60. Reference numeral 56 designates a hollowed section formed in the inner surface of the lead wire cover 32, which hollowed hole is provided to incorporate a three-phase wire 59 similarly to the hollowed section 51. Reference numeral 57 designates a wedge adapted to secure the side panels 38*a*, 38*b* to the cover 32. The wedge 57 serves to bring the hooks 39*c*, 39*d* and the hook 43 into close contact with each other to provide a rigid connection therebetween.

Reference numeral 36 designates a connection screw which is arranged extending through and between the side panels 38*a* and 38*b*. This connection screw 36 spreads the spacing between the side panel 38*a* and the side panel 38*b* to bring the hooks 39*a*, 39*b* into engagement with the hooks 48. Thereafter, the connection bolt 36 maintains the spacing between the side panel 38*a* and the side panel 38*b*. An eye-bolt 49 is provided on the end of the connection screw 36, and nuts 58 are provided on opposite sides in the portion through which side panels 38*a*, 38*b* extend. Reference numeral 61 designates a piping groove formed above the side panels 38*a*, 38*b*. This piping groove 61 is provided to avoid the interference with the piping installed in the lateral direction of the vehicle body of the underframe 13. Reference numeral 50 designates a wedge for securing the hooks 39*a*, 39*b* of the side panels 38*a*, 38*b* to the hook 48. This wedge 50 is inserted from the piping groove 61 and secured by means of a screw.

A wiring box 33 and a wiring pipe 34 are connected to the wiring duct 28. The wiring box 33 and the wiring pipe 34 are installed on the underframe 13 within the truck enclosures 4*a*, 4*b*.

Reference numeral 44 designates a low voltage wiring and 45 a high voltage wiring. These are separately bundled and encased within the wiring duct 28. The bundle of the low voltage wiring 44 and that of the high voltage wiring 45 are separately secured to the wire support 35. Reference numeral 46 designates an enclosure member formed on the undersurface of the underframe 13 as needed. Reference numeral 47 designates an enclosure arranged lengthwise of the wiring duct 28 and secured to the wire support 35. The side panels 38*a*, 38*b* and lead wire cover 32 are formed from material subjected to light alloy extrusion.

With the arrangement as described above, the procedure for the manufacture will be described. First, the side panels 38*a*, 38*b*, the wire support 35 and the lead wire cover 32 are assembled to form the wiring duct 28. Then, the low voltage wiring 44 and the high voltage wiring 45 or the three-phase wire 59 are encased in position. Thereafter, necessary wire 60 is pulled out of the lead wire hole 55, after which the low voltage wiring 44 and high voltage wiring 45 are bundled by the band 42 and fixed. When such a work is terminated, the spacing between the side panel 38*a* and side panel 38*b* is determined by the connection screw 36. With this, preparations of the wiring duct 28 are completed. The thus fabricated wiring duct 28 is mounted on the underframe 13. While this mounting work is the upward work if the state shown is used, this work can be formed into downward work by inverting the underframe 13 and wiring duct 28. The mounting work will be described in detail. First, either of the hooks 39*a*, 39*b* of the side panels 38*a*, 38*b* is placed in engagement with the hook 48 of the underframe 13. Then, the nut 58 is loosened and the eye-bolt 49 is pulled by a hydraulic jack or other pulling means whereby the spacing between the side panel 38*a* and the side panel 38*b* is spread through $\delta$ shown in FIG. 8. Then, the hooks 39*a*, 39*b* are placed in engagement with the other hook 48. Subsequently, the wedge 50 is inserted into and secured to the groove of each hook 48. The nut 58 of the connection screw 36 is tightened to completely secure the wiring duct 28 to the underframe 13. Prior to securing the wiring duct 28 to the underframe 13, various wirings are also installed in the wiring box 33 and the wiring pipe 34.

According to the structure as described above, the fabrication of the wiring duct 28 can be extremely simply carried out merely by a combination of the side panels 38*a*, 38*b*, the wire support 35 and the lead wire cover 32. Aligning of various members can be easily accomplished. Accordingly, the workability can be enhanced. Next, the mounting of the wiring duct 28 on the underframe 13 can be carried out by engagement of the hooks 39*a*, 39*b* of the side panels 38*a*, 38*b* with the hook 48 of the underframe 13. Accordingly, since no welding work is involved, the work can be done easily. The securing of the hooks 39*a*, 39*b* to the hook 48 is done merely by inserting and fastening the wedge 50, and so, the work is simple. Those giving rise to the electromagnetic intereference such as the three-phase wiring 59 are mounted on the side panels 38*a*, 38*b* and the hollowed sections 51, 56 of the lead wire cover 32, and therefore it is possible to prevent the other wirings from being adversely affected. The lead wire cover 32 can be freely changed in its installation with respect to the side panels 38*a*, 38*b*, and alignment between the underfloor equipment 11 to which the wiring 60 is connected and the hole 55 can be done easily. The side panels 38*a*, 38*b* are formed with the fixed groove 41, and the band 42 for securing the wiring can be simply fixed, and the work can be done easily.

As previously mentioned, the wiring duct 28 is mounted on the underframe 13, and the underfloor equipment 11 is further mounted, and the wiring extended from the wiring duct 28 is connected to the underfloor equipment 11. After termination of the work as described above, the truck enclosures 4*a*, 4*b* and the enclosure for underfloor equipment 10 are mounted. Accordingly, when the installing work of the wiring duct 28 and underfloor equipment 11 and the wiring work between the underfloor equipment are being done, the truck enclosures 4*a*, 4*b* and the enclosure for underfloor equipment 10 are not yet installed, and therefore, the workability can be considerably enhanced. As described above, according to the present invention, in the manufacture of the underfloor construction of the monorail vehicle, the workability can be enhanced to reduce the number of manufacturing steps.

We claim:

1. An underfloor construction of a monorail vehicle having at least first and second trucks, comprising first and second truck enclosure units located in spaced relation and respectively enclosing said first and second trucks of said vehicle, each of said first and second truck enclosure units having side, front and rear surfaces that surround the periphery of its associated truck of said monorail vehicle with each of said two side surfaces of each unit being located in the same plane as a side of a body of the monorail vehicle, and said first and second truck enclosing units each having an upper frame through which the units are mounted to a frame of said monorail vehicle; and first and second equipment enclosures for covering the outer and lower surfaces of equipment mounted on the frame of said vehicle, each of said first and second equipment enclosures having a side surface located in the same plane as a side of the vehicle body and the side surface of said truck enclosure units, and said first and second equipment enclosures being mounted on respective ones of both sides widthwise of the vehicle body to the frame of said vehicle between said first and second truck enclosure units.

2. An underfloor construction of a monorail vehicle according to claim 1, wherein each of said first and second equipment enclosure units comprises outside supports mounted on the outer undersurface of an upper frame; inside supports capable of being inserted between equipments mounted on the underframe of said vehicle; lower frames connecting the ends of the inside supports and outside supports; a skirt connected to the outer surface of said outside support; and a cover supported by said outside supports and said inside supports to cover the lower surfaces of equipments mounted to the frame of said vehicle.

3. An underfloor construction a monorail vehicle comprising: a wiring duct which receives wires connected to equipment mounted on the undersurface of a frame of said vehicle, said duct being mounted in a central portion widthwise of a vehicle body of said vehicle in the undersurface of the frame and extending lengthwise of the vehicle body; a truck enclosure unit which is formed into a unit having side, front and rear surfaces surrounding four surfaces of the periphery of a truck of said vehicle, said truck enclosure unit being constructed separately from the frame of said vehicle, each of the side surfaces of the truck enclosure unit positioned in the same plane as a side of the vehicle body, said unit being mounted on the frame corresponding to a position at which the truck is installed in the undersurface of the frame and equipment enclosure units which cover the outer surface and lower surface of equipments mounted on the undersurface of the frame, a side surface of each of said equipment enclosure units positioned in the same plane as a side of the vehicle body and the side surface of said truck enclosure unit, and said equipment enclosure units being mounted on both sides widthwise of the vehicle body in the undersurface of the frame adjacent to said truck enclosure unit.

4. A method of assembling an underfloor construction of a monorail vehicle, comprising: mounting a wiring duct directly on the central portion widthwise of the body of the monorail vehicle on the undersurface of a frame of said vehicle body so that said duct extends lengthwise of the vehicle body whereby wiring within said duct can electrically connect equipments mounted on the undersurface of the frame of the vehicle body; mounting a truck enclosure unit to the undersurface of said frame of the vehicle, said truck enclosure unit having side, front and rear surfaces being formed into a unit surrounding four surfaces of the periphery of a truck of said vehicle, each of the side surfaces of said unit positioned in the same plane as a side of the body of said vehicle, said unit being mounted on the frame at a position corresponding to a position at which a truck is installed in the undersurface of the frame, and mounting equipment enclosure units which cover the outer surface and lower surface of said equipments mounted on the undersurface of the frame, a side surface of each of said equipment enclosure units positioned in the same plane as a side of the vehicle body and the side surface of said truck enclosure unit, said equipment enclosure units being mounted on both sides widthwise of the vehicle body in the undersurface of the frame adjacent to said truck enclosure unit.

* * * * *